United States Patent [19]

Suga

[11] Patent Number: 4,936,264

[45] Date of Patent: Jun. 26, 1990

[54] INTAKE- AND/OR EXHAUST-VALVE TIMING CONTROL SYSTEM FOR INTERNAL COMBUSTION ENGINES

[75] Inventor: Seiji Suga, Kanagawa, Japan

[73] Assignee: Atsugi Unisia Corporation, Kanagawa, Japan

[21] Appl. No.: 411,884

[22] Filed: Sep. 25, 1989

[30] Foreign Application Priority Data

Sep. 26, 1988 [JP] Japan ..... 63-125508[U]

[51] Int. Cl.[5] ..... F01L 1/34

[52] U.S. Cl. ..... 123/90.17; 123/90.31

[58] Field of Search ..... 123/90.17, 90.15, 90.12, 123/90.13, 90.31

[56] References Cited

U.S. PATENT DOCUMENTS

| | | | |
|---|---|---|---|
| 4,231,330 | 11/1980 | Garcea | 123/90.15 |
| 4,494,496 | 1/1985 | Nakamura et al. . | |
| 4,535,731 | 8/1985 | Banfi . | |
| 4,811,698 | 3/1989 | Akasaka et al. . | |
| 4,856,465 | 8/1989 | Denz et al. . | |
| 4,862,843 | 9/1989 | Kawamoto et al. | 123/90.17 |

FOREIGN PATENT DOCUMENTS

| | | | |
|---|---|---|---|
| 61-279713 | 12/1986 | Japan . | |
| 62-251412 | 2/1987 | Japan . | |
| 0003112 | 1/1987 | Japan | 123/90.17 |

*Primary Examiner*—David A. Okonsky
*Assistant Examiner*—Weilun Lo
*Attorney, Agent, or Firm*—Ronald P. Kananen

[57] ABSTRACT

An intake- and/or exhaust-valve variable timing control system for an internal combustion engine comprises a ring gear member disposed between a timing pulley and a camshaft and a drive mechanism for drivingly controlling the ring gear member via oil pressure depending upon the operating state of the engine. The ring gear member includes first and second ring gear elements having essentially the same geometry of inner and outer toothed portions and a backlash eliminator associated with the two ring gear elements. At least one of the two meshing pairs of toothed portions is helical. The timing control system also includes a stepped end provided at the rear end of the inner toothed portion of the timing pulley, an abutting portion provided on the outer peripheral surface of the second ring gear element, for abutting said stepped end to restrict an axial sliding movement of the second ring gear element to the outermost end of said timing pulley, and an opening defined in the vicinity of the outermost end of said timing pulley, for permitting the first ring gear element to axially move away from the second ring gear element.

8 Claims, 4 Drawing Sheets

INTAKE- AND/OR EXHAUST-VALVE TIMING CONTROL SYSTEM FOR INTERNAL COMBUSTION ENGINES

BACKGROUND OF THE INVENTION

1. Field of the Invention

The present invention relates to an intake-and/or exhaust-valve timing control system for internal combustion engines which is variably capable of controlling the intake- and/or exhaust-valve timing depending on the operating state of the engine, for example, the magnitude of engine load and/or engine speed.

2. Description of the Prior Art

Recently, there have been proposed and developed various intake- and/or exhaust-valve timing control systems for internal combustion engines for generating optimal engine performance according to the operating state of the engine.

As is generally known, the valve timing is determined such that optimal engine performance is obtained. However, the predetermined valve timing is not suitable under all operating conditions. For example, when the engine is operating within a range of low revolutions, higher torque will be obtained with an intake-valve timing earlier than the predetermined valve timing.

Such a conventional intake- and/or exhaust-valve timing control system for internal combustion engines has been disclosed in U.S. Pat. No. 4,231,330. In this conventional valve timing control system, a cam sprocket is rotatably supported through a ring gear mechanism by the front end of a cam shaft. The ring gear mechanism includes a ring gear having an inner toothed portion engaging another toothed portion formed on the front end of the camshaft and an outer toothed portion engaging an inner toothed portion formed on the inner peripheral wall of the cam sprocket. In this manner, the ring gear rotatably engages between the cam sprocket and the camshaft. The ring gear is normally biased in the axial direction of the camshaft by spring means, such as a coil spring. At least one of the two meshing pairs of gears is helical. The result is that axial sliding movement of the ring gear relative to the camshaft causes the camshaft to rotate about the cam sprocket and therefore the phase angle between the camshaft and the cam sprocket (that is, the phase angle between the camshaft and the crankshaft) is relatively varied. The ring gear moves as soon as one of the two opposing forces acting on it, namely, the preloading pressure of the above spring means or the oil pressure applied from the oil pump through the flow control valve to the ring gear, exceeds the other. However, in this conventional valve timing control system, each of the two meshing pairs of gears has backlash or play therebetween. During operation of the ring gear, the backlash results in collision between the teeth and thereby causes noise and fluctuations in the torque of the camshaft.

To avoid the above problem, an improved conventional intake- and/or exhaust-valve timing control system has been disclosed in Japanese Patent First Publication (Jikkai Showa) 61-279713. In this valve timing control system, the ring gear, which is disposed between the timing pulley and the camshaft, includes a pair of ring gear elements. One such conventional valve timing control system is shown in FIGS. 1 and 2.

Referring now to FIG. 1, a ring gear member 3 is comprised of a first ring gear element 3*c* and a second ring gear element 3*d*. The first and second ring gear elements 3*c* and 3*d* are formed in such a manner as to divide a relatively large ring gear including inner and outer toothed portions 3*b* and 3*a* into two parts by cutting or milling. Therefore, the first and second ring gear elements 3*c* and 3*d* have essentially the same geometry with regard to the inner and outer teeth. These ring gear elements 3*c* and 3*d* are interconnected by a plurality of connecting pins 3*f* which are fixed on the second ring gear element 3*d* through the annular hollow defined in the first ring gear element 3*c*. The annular hollow is traditionally filled with elastic materials, such as cylindrical rubber bushing attached by vulcanizing. Alternatively, as shown in FIG. 1, a plurality of coil springs 3*e* may be provided in the annular hollow, while the springs 3*e* are supported by the heads of the connecting pins 3*f* serving as spring seats. In this conventional timing control system, when the first and second ring gear elements 3*c* and 3*d*, and the connecting pins 3*f* are assembled, the first and second ring gear elements 3*c* and 3*d* are interconnected in such a manner as to be slightly offset from each other. In other words, the angular phase relationship between the two ring gears 3*c* and 3*d* is designed so as to be set to an angular position slightly offset from an angular position in which the tooth traces between the two ring gear elements 3*c* and 3*d* are exactly aligned with each other. The above mentioned offset is preset to a slightly greater value than the offset of the ring gear member when meshed with its connecting gears. In this construction of the ring gear member 3, due to the offsetting of the elements 3*c* and 3*d*, the apparent tooth thickness of each tooth of the ring gear member is greater than the actual tooth thickness. In FIG. 1, reference numeral 1*a* denotes an inner toothed portion formed on the inner peripheral wall of a timing pulley 1, while reference numeral 2*a* denotes an outer toothed portion formed on the outer peripheral wall of a sleeve 2*b* fixed on the front end of a camshaft 2. Reference numeral 4*a* denotes an oil pump to generate the working oil pressure used to activate axial sliding movement of the ring gear member. Reference numeral 5 designates a timing belt for transmitting torque from the engine crankshaft to the timing pulley 1. At least one of the two meshing pairs of teeth (1*a*, 3*a*, and 2*a*, 3*b*) is helical to provide axial sliding movement of the ring gear relative to the camshaft 2. The procedure for installation of the ring gear 3 will be as follows:

First, the outer toothed portion 3*a* of the ring gear assembly and the inner toothed portion 1*a* of the pulley 1 are meshed with each other under a condition wherein the two ring gear elements 3*c* and 3*d* are twisted relative to each other so as to reduce the previously described apparent tooth thickness, in other words, the teeth of the ring gear elements 3*c* and 3*d* are substantially aligned thereby facilitating engagement between the outer toothed portion 3*a* and the inner toothed portion 1*a*.

After this, the outer toothed portion 2*a* of the sleeve 2*b* is meshed with the inner toothed portion 3*b* of the ring gear assembly. However, engagement between the outer toothed portion 2*a* and the inner toothed portion 3*b* is not facilitated. FIG. 2 shows the positional relationship of the tooth traces of the inner teeth 3*b* of the first and second ring gear elements 3*c* and 3*d* at the pitch circle of the ring gear member 3. As clearly seen in FIG. 2, under a condition wherein the outer toothed portion 3*a* of the ring gear 3 is engaged with the inner toothed portion 1a of the timing pulley, the apparent tooth thickness t of the inner toothed portion 3b is slightly greater than the actual tooth thickness, since backlash between the outer toothed portion 3a and the inner toothed portion 1a is eliminated by the return spring force generated by the cylindrical rubber bushing or the coil springs 3e serving as a backlash eliminator. Therefore, the apparent tooth spacing s of the inner toothed portion 3b is less than the actual tooth spacing. That is, the apparent tooth spacing s of the inner toothed portion 3b is substantially equal to the tooth thickness of the toothed portion 2a. As a result, the outer toothed portion 2a of the camshaft 2 is easily meshed with the inner toothed portion 3b of the second ring gear element 3d. However, the toothed portion 2a is not easily meshed with the inner toothed portion 3b of the first ring gear element 3c, since a portion of the side wall of the toothed portion 2a tends to abut that of the toothed portion 3b as best seen in FIG. 2. If the machining accuracy of the meshing pair of teeth (3b, 2a) is low, there is a possibility that the apparent tooth spacing s at a particular section of the toothed portion 3b is less than the disirable apparent tooth spacing or that the actual tooth thickness at a particular section of the toothed portion 2a exceeds the disirable tooth thickness. Furthermore, if the machining accuracy is low and for instance the actual backlash between the inner toothed portion 1a of the timing pulley 1 and the outer toothed portion 3a of the first or second ring gear element is greater than a predetermined designed value, the offset between the tooth traces of the two ring gear elements 3c and 3d is increased and as a result the apparent tooth spacing s of the inner toothed portion 3b of the ring gear member is reduced. Under these conditions, engagement between the inner and outer toothed portions 3b and 2a becomes extremely difficult. Therefore, it is desirable that the machining accuracy of the toothed portions 2a and 3b is high and the backlash of the meshing pair of teeth is small. However, this results in an increase of the overall cost of manufacturing the valve timing control system. Moreover, in such conventional valve timing control systems, during the engagement between the inner and outer toothed portions 3b and 2a, assuming that the first ring gear element 3c abuts a hypothetical abutting surface 1b of the timing pulley 1, these toothed portions are forcibly meshed with each other by pressure after the engagement between toothed portions 1a and 3a, thereby resulting in damage to toothed portions 2a and 3b.

SUMMARY OF THE INVENTION

It is, therefore in view of the above disadvantages, an object of the present invention to provide an intake- and/or exhaust-valve timing control system for internal combustion engines, the system including a ring gear member being comprised of a pair of ring gear elements with a backlash eliminator, in which, during installation of the ring gear member, the outer and inner toothed portions of the ring gear member are easily meshed with the inner toothed portion of a timing pulley or a camshaft sprocket and the outer toothed portion of a camshaft, respectively.

It is another object of the invention to provide an intake- and/or exhaust-valve timing control system which can be manufactured at relatively low cost.

According to one aspect of the invention, an intake- and/or exhaust-valve timing control system for an internal combustion engine comprises a camshaft including an outer toothed portion at the outer peripheral circumference thereof, a substantially cylindrical rotating member having a driven connection with a crankshaft of the engine, the rotating member including an inner toothed portion at an inner peripheral surface thereof, a ring gear member including first and second ring gear elements having essentially the same inner and outer geometry and means for elastically interconnecting the first and second ring gear elements such that the two ring gear elements are coaxially arranged and the tooth traces of the two ring gear elements are slightly offset. The inner and outer toothed portions of the ring gear member are respectively meshed with the outer toothed portion of the camshaft and the inner toothed portion of the rotating member. At least one of the two meshing pairs of toothed portions is helical. The timing control system also includes a drive mechanism for drivingly controlling the ring gear member via oil pressure depending upon the operating state of the engine. The timing control system further includes a stepped end provided at the end of the inner toothed portion of the rotating member, facing away from the outermost end of the rotating member, an abutting portion provided on the outer peripheral surface of the second ring gear element, for abutting the stepped end to restrict axial sliding movement of the second ring gear element toward the outermost end of the rotating member, and an opening defined in the vicinity of the outermost end of the rotating member, for permitting the first ring gear element to axially move away form the second ring gear element in the direction of the outermost end of the rotating member.

The interconnecting means includes a cylindrical rubber bushing filling in an annular hollow coaxially defined in the first ring gear element and a plurality of connecting pins being fixed on the second ring gear element through the cylindrical rubber bushing, whereby the first and second ring gear elements are elastically interconnected in such a manner as to be relatively capable of moving in both the rotational and axial directions. The interconnecting means may include a plurality of connecting pins being fixed on the second ring gear element through an annular hollow coaxially defined in the first ring gear element and a plurality of coil springs provided in the annular hollow of the first ring gear element, each of the springs being supported by the head of the associated pin so as to normally bias the second ring gear element to the first ring gear element.

The second ring gear element includes a substantially thin, cylindrical outer peripheral surface axially extending away from the first ring gear element. The abutting portion is formed on the cylindrical outer peripheral surface of the second ring gear element, whereby, during insertion of the ring gear member through the opening of the rotating member, the cylindrical outer peripheral surface of the second ring gear element 3d is elastically deformable radially and inwardly.

The intake- and/or exhaust-valve timing control system further comprises a lid hermetically covering the opening of the rotating member in an airtight fashion to define a pressure chamber associated with the drive mechanism in conjunction with the first ring gear element. The outermost position of the ring gear member is determined by the abutment between the outer perimeter of the lid and the outer perimeter of the first ring gear element, in which the relative phase angle between the rotating member and the camshaft is set to a predetermined phase angle.

BEST MODE FOR CARRYING OUT THE INVENTION

Figure 3:
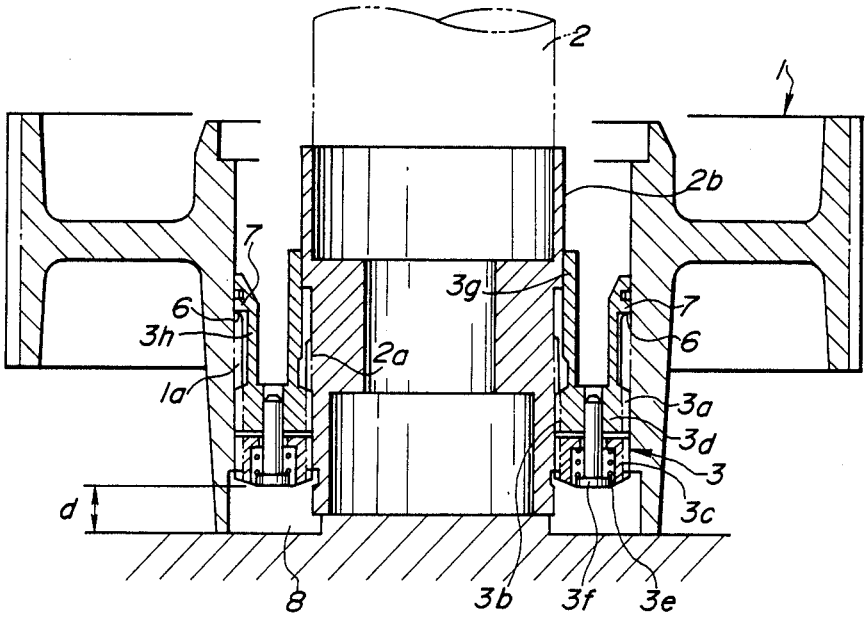
FIG. 3 is a cross sectional view illustrating an intake and/or exhaust valve control system according to the invention under a condition wherein the ring gear member is installed on a surface plate between the timing pulley and the camshaft.
Figure 4A:
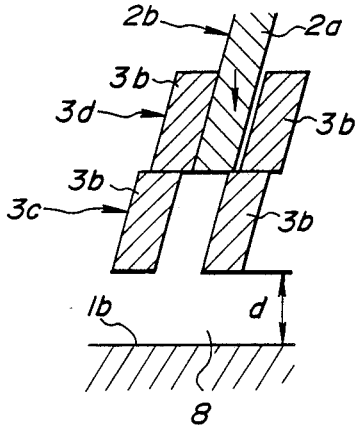
FIGS. 4A and 4B are an explanatory drawings illustrating the positional relationship between the tooth traces of the inner toothed portions of the two ring gear elements and the outer toothed portion of the camshaft.
Figure 4B:
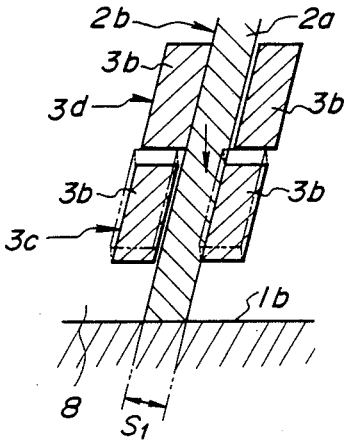
Figure 5:
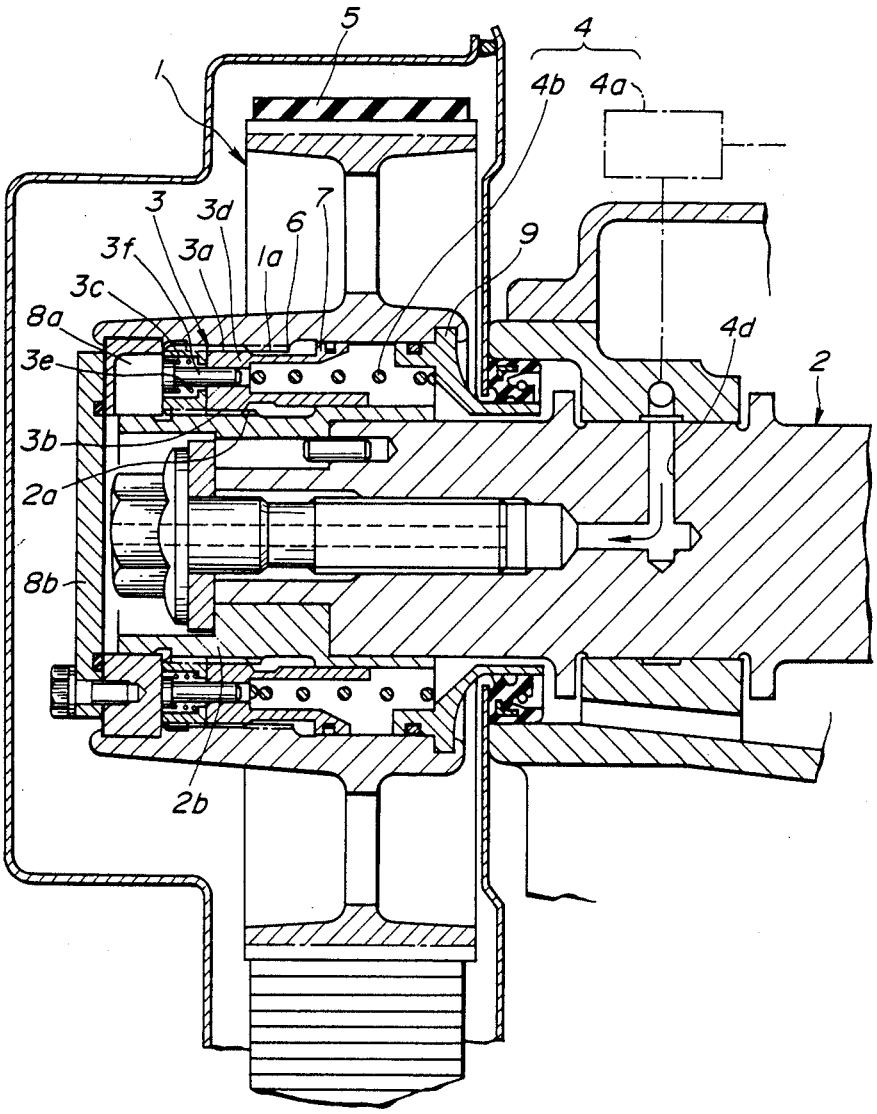
FIG. 5 is a cross sectional view illustrating one preferred embodiment of an intake- and/or exhaust-valve timing control system for internal combustion engines according to the invention.

The principles of the present invention applied to intake- and/or exhaust-valve timing control systems for internal combustion engines are illustrated in FIGS. 3 to 5.

Figure 1:
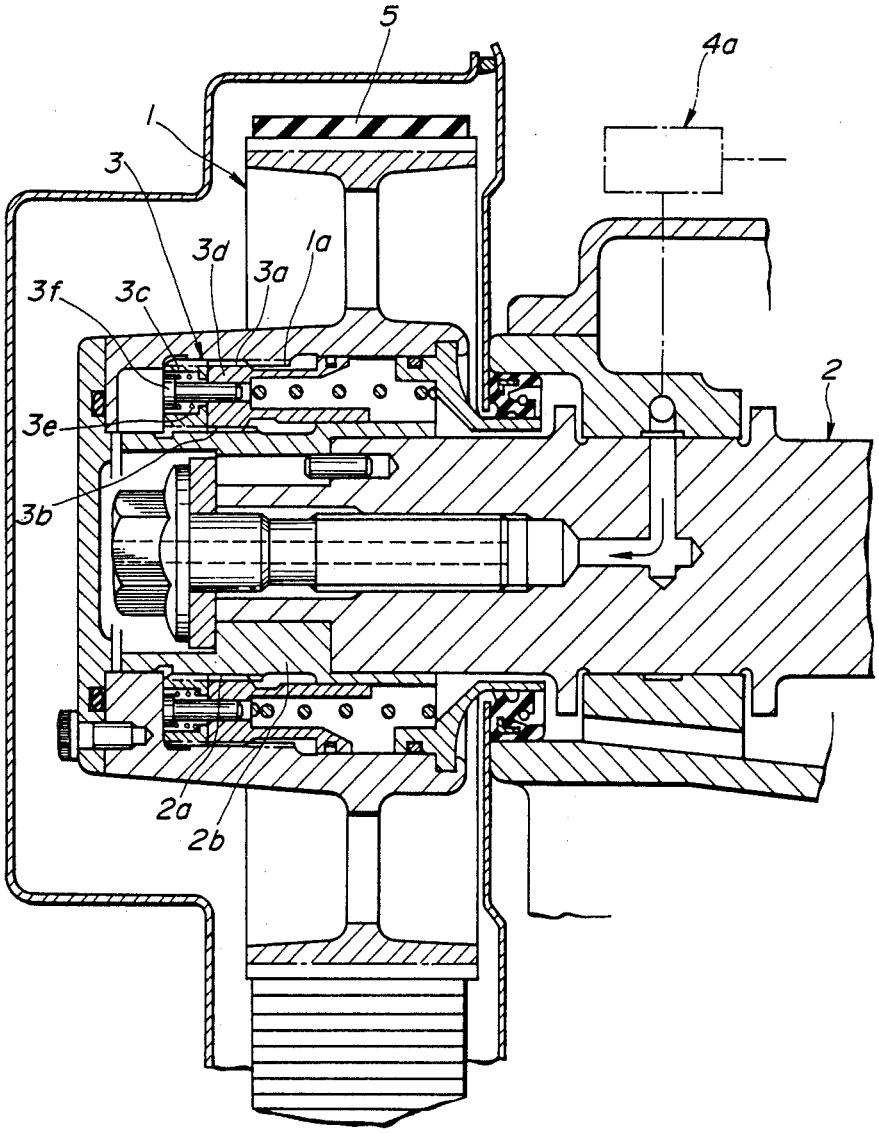
FIG. 1 (PRIOR ART)
FIG. 1 is a cross sectional view illustrating a conventional intake- and/or exhaust valve timing control system for internal combustion engines, including a pair of ring gear elements with a backlash eliminator.
Figure 2:
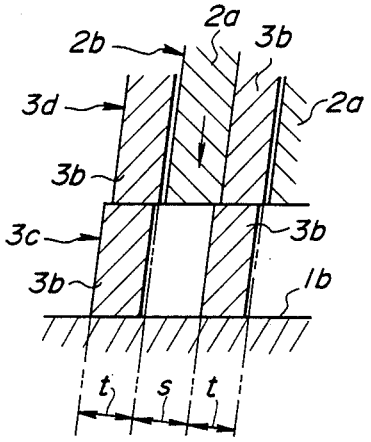
FIG. 2 (PRIOR ART)
FIG. 2 is an explanatory drawing illustrating the positional relationship between the tooth traces of each inner toothed portion of the two ring gear elements.

In the preferred embodiment, the same reference numerals used to designate elements in the conventional valve timing control system for internal combustion engines as shown in FIG. 1 will be applied to corresponding elements used in the present embodiment according to the invention for the purpose of comparing the conventional system and the improved system.

As shown in FIG. 3, the preferred embodiment is different from the conventional valve timing system shown in FIG. 1 in that, when the outer toothed portion 2*a* of the sleeve 2*b* of the camshaft 2 is meshed with the inner toothed portion 3*b* of the ring gear member 3 under a condition of engagement between the outer toothed portion 3*a* of the ring gear member 3 and the inner toothed portion 1*a* of the timing pulley 1, the first ring gear element 3*c* is capable of moving away from the second ring gear element 3*d*.

Referring now to FIG. 3, the timing pulley 1 includes a relatively long inner toothed portion 1*a* extending in the axial direction thereof. The inner toothed portion 1*a* is formed on the inner peripheral surface of the pulley 1 in such a manner as to project radially and inwardly with regard to the axis of the pulley 1. Therefore, the inner toothed portion 1*a* has a stepped end 6. The outer toothed portion 2*a* is formed on the outer peripheral surface of the sleeve 2*b* which is fixed on the front end of the camshaft 2 to rotate with the camshaft 2. The ring gear member 3 is comprised of first and second ring gear elements 3*c* and 3*d*, a plurality of connecting pins 3*f*, and an annular rubber bushing or a plurality of coil springs 3*e*. The first and second ring gear elements 3*c* are formed in such a manner as to divide a relatively large ring gear, including inner and outer toothed portions 3*b* and 3*a* into two ring gear elements. The above mentioned construction of the intake- and/or exhaust-valve timing control system according to the embodiment is similar to the conventional valve timing control system as shown in FIG. 1.

The second ring gear element 3*d* of the valve timing control system according to the invention has inner and outer annular rings 3*g* and 3*h* axially extending from the toothed portion thereof. The inner annular ring 3*g* is slidably and rotatably in contact with the outer peripheral surface of the sleeve 2*b* at the inner peripheral surface thereof. The outer annular ring 3*h* includes a relatively thin cylindrical section with the result that the outer annular ring 3*h* is elastically deformable in such a manner as to be capable of reducing the outer diameter thereof. The outer annular ring 3*h* includes an abutting portion 7 formed at the free end thereof. The abutting portion 7 abuts the stepped end 6 of the inner toothed portion 1*a* so as to restrict axial sliding movement of the second ring gear element 3*d* in the direction of the front end of the pulley 1 (the lower direction in FIG. 3). Additionally, the timing pulley 1 includes an annular opening 8 at the front end thereof. The opening 8 permits the first ring gear element 3*c* to axially move in the direction of the front or outermost end of the pulley 1, while the inner toothed portion 3*b* is meshed with the outer toothed portion 2*a*.

The ring gear 3 of the valve timing control system according to the invention is installed between the inner toothed portion 1*a* of the pulley 1 and the outer toothed portion 2*a* of the sleeve 2*b* of the camshaft 2 in accordance with the following order of assembly:

First, the outer toothed portion 3*a* of the ring gear member 3 and the inner toothed portion 1*a* of the pulley 1 are meshed with each other, while the two ring gear elements 3*c* and 3*d* are twisted with respect to each other so as to align the toothed portion of each element, thus reducing the apparent tooth thickness of each tooth of the ring gear member 3. In this case, the ring gear member 3 may be inserted through the rear opening of the pulley 1 to engage the pulley. Alternatively, the ring gear member 3 may be inserted through the front opening 8 of the pulley 1 into the pulley 1 while the outer annular ring 3*h* is inwardly deformed in such a manner as to reduce the outer diameter thereof. In the latter installation method, the outer annular ring 3*h* is radially and outwardly expanded, as soon as the abutting portion 7 of the second ring gear element 3*d* passes through the stepped end 6 of the inner toothed portion 1*a*. In this manner, after completion of the mesh between the inner toothed portion 1*a* and the outer toothed portion 3*a*, the axial sliding movement of the second ring gear element 3*d* in the lower direction (viewing FIG. 3) is restricted by the abutment of the stepped end 6 and the abutting portion 7. Under those restricted condition of the second ring gear element 3*d*, the ring gear member 3 is supported by the stepped end 6 in such a manner as to maintain the clearance d between the first ring gear element 3*c* and the front end of the pulley 1. Thus, the first ring gear element 3*c* is movable through the opening 8 in the lower direction as clearly seen in FIG. 3. As a result, the first ring gear element 3*c* can slide away from the second ring gear element 3*d* in such a manner that the abutting side walls of the first and second ring gear elements 3*c* and 3*d* separate from each other.

Subsequently, the outer toothed portion 2*a* of the sleeve 2*b* is inserted through the rear opening of the pulley 1 into the inner toothed portion 3*b* of the second ring gear element 3*d*. At this time, as previously described in the prior art disclosure, the apparent tooth thickness t of the inner toothed portion 3*b* is slightly greater than the actual tooth thickness, since the backlash between the outer toothed portion 3*a* and the inner toothed portion 1*a* is eliminated by the cylindrical rubber bushing or the coil springs 3*e* serving as a backlash eliminator. Therefore, the apparent tooth spacing s of the inner toothed portion 3*b* is less than the actual tooth spacing. In other words, the apparent tooth spacing s of the inner toothed portion 3*b* is narrowed down. For this reason, after the outer toothed portion 2*a* of the camshaft 2 is meshed with the inner toothed portion 3*b* of the second ring gear element 3*d*, a portion of the side wall of the toothed portion 2*a* will abut that of the toothed portion 3*b* as best seen in FIG. 4A. Assuming that the inner and outer toothed portions 3*b* and 2*a* are helical gears, when the sleeve 2*b* is slightly rotated along the tooth trace of the inner toothed portion 3*b* and axially pressed into the first ring gear element 3*c* after the engagement between the outer toothed portion 2*a* of the sleeve 2*b* and the inner toothed portion 3*b* of the second ring gear element 3*d*, the side wall of the outer toothed portion 2*a* pushes the associated side wall of the first ring gear element 3*c* in the lower direction (viewing FIG. 4A) against the return spring force generated by the backlash eliminator 3*e*. Consequently, as shown in FIG. 4B, the axial sliding movement of the second ring gear element 3*d* is restricted by the abutment between the stepped end 6 and the abutting portion 7, while the first ring gear element 3*c* axially moves due to the above mentioned clearance d defined by the opening 8. As a result, the apparent tooth spacing s of the inner toothed portion 3*b* is gradually widened depending upon the amount of the axial sliding movement of the first ring gear element 3*c*. In this manner, as soon as the tooth spacing s of the inner toothed portion 3*b* reaches a value $s_1$, slightly greater than the tooth thickness of the outer toothed portion 2*a*, the outer toothed portion 2*a* becomes meshed with the inner toothed portion 3*b* of the first ring gear element 3*c*. Under this condition, the backlash between the meshing sets of gear teeth 2*a* and 3*b* is eliminated as seen in FIG. 4B.

As set forth above, the ring gear member 3 is assembled between the inner toothed portion 1*a* of the pulley 1 and the outer toothed portion 2*a* of the sleeve 2*b* of the camshaft 2, such that backlash between each set of gear teeth (1*a*, 3*a*; 2*a*, 3*b*) is eliminated by the return spring force caused by the elastic rubber bushing or the coil springs 3*e*.

FIG. 5 is a cross sectional view illustrating an intake- and exhaust-valve timing control system of the invention assembled in accordance with the procedure of FIG. 3. Referring now to FIG. 5, reference numeral 4 designates a ring gear drive mechanism for activating an axial sliding movement of the ring gear member 3. The ring gear drive mechanism 4 includes an oil pump 4i a for generating oil pressure through an oil passage 4*d* defined in the camshaft 2 to a pressure chamber 8*a* which is defined by the first ring gear element 3*c*, the front end of the sleeve 2*b*, and the front lid 8b closing the front opening 8 of the pulley 1 in an airtight fashion to define the oil pressure chamber 8*a* at the front surface of the first ring gear element 3*c*. The ring gear drive mechanism 4 also includes a return spring 4*b* disposed between the second ring gear element 3*d* and a substantially annular retainer 9 for normally biasing the ring gear member 3 in an axially forward direction. The lid 8*b* and the retainer 9 are respectively fixed on the front and rear end portions of the hub of the pulley 1 by caulking.

When the engine is operated under high load, working oil is supplied form the oil pump 4*a* through the oil passage 4*d* to the pressure chamber 8*a*. As a result, since the pressure of the working oil within the pressure chamber 8*a* becomes high, the ring gear member 3 is moved in the right direction (viewing FIG. 5) against the spring force generated by the spring 4*b*. Therefore, the phase angle between the pulley 1 and the camshaft 2 is changed to a predetermined phase angle which corresponds to an optimal phase angle during high engine load conditions. In this manner, for example, the intake-valve timing is set backward with the result that the charging efficiency of the air-fuel mixture is ameliorated.

Conversely, when the operating state of the engine is changed from a high load to a low load, the oil supply from the oil pump 4*a* is blocked by a flow control valve (not shown) and the working oil is returned through the flow control valve to the oil pan (not shown). As a result, the pressure within the pressure chamber 8*a* becomes low, and therefore the ring gear member 3 is positioned at the leftmost position (viewing FIG. 5) by the spring 4*b*. This leftmost position is determined by the abutment of the outer perimeter of the lid 8*b* with the outer perimeter of the first ring gear element 3*c*. Under this condition, the relative phase angle between the pulley 1 and the camshaft 2 is set to a predetermined phase angle in which an intake- and/or exhaust-valve timing relative to the crank angle is initialized. In this manner, for example, the intake-valve timing is set forward with the result that the burned gases are efficiently exhausted and thus the amount of residual burned gases is reduced. Therefore, optimal burning is executed, resulting in stable engine combustion and improvement in fuel consumption.

In the above described embodiment, although the meshing pair of toothed portions 2*a* and 3*b* are helical gears and the meshing pair of toothed portions 1*a* and 3*a* are either helical gears or spur gears, the meshing pair of toothed portions 2*a* and 3*b* may be spur gears and the meshing pair of toothed portions 1*a* and 3*a* may be helical gears. In this case, the inner toothed portion 1*a* of the pulley 1 may first be meshed with the outer toothed portion 3*a* of the ring gear 3 and thereafter the sleeve 2*b* may be slightly rotated along the tooth trace of the outer toothed portion 3*a* and axially pressed into the first ring gear element 3*c*, after the engagement between the outer toothed portion 2*a* of the sleeve 2*b* and the inner toothed portion 3*b* of the second ring gear element 3*d*. Likewise, the first ring gear element 3*c* may axially move away from the second ring gear element 3*d*. As a result, the apparent tooth spacing s of the outer toothed portion 3*a* may become greater. In this way, even though the meshing pair of toothed portions 2*a* and 3*b* are spur gears and the pair of toothed portions 1*a* and 3*a* are helical gears, the ring gear member 3 may be easily assembled between the inner toothed portion 1*a* of the pulley 1 and the outer toothed portion 2*a* of the sleeve 2*b* of the camshaft 2.

In the above described embodiment, although a timing pulley associated with a timing belt is used for a timing control system according to the invention, a camshaft sprocket associated with a timing chain may be replaced with the timing pulley.

While the foregoing is a description of the best mode for carrying out the invention, it will be understood that the invention is not limited to the particular embodiments shown and described herein, but may include variations and modifications without departing from the scope or spirit of this invention as described by the following claims.

What is claimed is:

1. An intake- and/or exhaust-valve timing control system for an internal combustion engine comprising:

a camshaft including an outer toothed portion at the outer peripheral surface thereof;

a substantially cylindrical rotating member having a driven connection with a crankshaft of the engine, said rotating including an inner toothed portion at the inner peripheral surface thereof;

a ring gear member including first and second ring gear elements having essentially the same geometry of inner and outer toothed portions and means for elastically interconnecting the first and second ring gear elements such that the two ring gear elements are coaxially arranged and the tooth traces of the two ring gear elements are slightly offset, the inner and outer toothed portions of said ring gear member being respectively meshed with the outer toothed portion of said camshaft and the inner toothed portion of said rotating member, at least one of the two meshing pairs of toothed portion being helical;

a drive mechanism for drivingly controlling said ring gear member via oil pressure depending upon the operating state of the engine;

a stepped end provided at the end of the inner toothed portion of said rotating member, facing away from the outermost end of said rotating member;

an abutting portion provided on the outer peripheral surface of the second ring gear element, for abutting said stepped end to restrict axial sliding movement of the second ring gear element to the outermost end of said rotating member; and an opening defined in the vicinity of the outermost end of said rotating member, for permitting the first ring gear element to axially move away from the second ring gear element in the direction of the outermost end of said rotating member.

2. The intake- and/or exhaust-valve timing control system as set forth in claim 1, wherein said rotating member comprises a timing pulley.

3. The intake- and/or exhaust-valve timing control system as set forth in claim 1, wherein said rotating member comprises a camshaft sprocket.

4. The intake- and/or exhaust-valve timing control system as set forth in claim 1, wherein said interconnecting means includes cylindrical rubber bushing filling in an annular hollow coaxially defined in said first ring gear element and a plurality of connecting pine being fixed on said second ring gear element through the cylindrical rubber bushing, whereby said first and second ring gear elements are elastically interconnected in such a manner as to be relatively capable of moving in both the rotational and axial directions.

5. The intake- and/or exhaust-valve timing control system as set forth in claim 1, wherein said interconnecting means includes a plurality of connecting pins being fixed on said second ring gear element through an annular hollow coaxially defined in said first ring gear element and a plurality of coil springs provided in the annular hollow of said first ring gear element, each spring being supported by the head of the associated pin so as to normally bias said second ring gear element to said first ring gear element.

6. The intake- and/or exhaust-valve timing control system as set forth in claim 1, wherein said second ring gear element includes a substantially thin, cylindrical outer peripheral surface, axially extending away from said first ring gear element, said abutting portion being formed on the cylindrical outer peripheral surface of said second ring gear element, whereby, during insertion of said ring gear member through said opening of said rotating member, the cylindrical outer peripheral surface is elastically deformable radially and inwardly.

7. The intake- and/or exhaust-valve timing control system of claim 1 further comprising:

a lid hermetically covering said opening in an air tight fashion to define a pressure chamber associated with said drive mechanism in conjunction with said first ring gear element.

8. The intake- and/or exhaust-valve timing control system as set forth in claim 7, wherein the outermost position of said ring gear member is determined by the abutment between the outer perimeter of said lid and the outer perimeter of said first ring gear element, in which the relative phase angle between said rotating member and said camshaft is set to a predetermined phase angle.

* * * * *